US006053757A

United States Patent [19]

Turnbull

[11] Patent Number: 6,053,757

[45] Date of Patent: Apr. 25, 2000

[54] PRINTED CIRCUIT BOARD EDGE CARD CONNECTOR HAVING TWO NON-REDUNDANT ROWS OF CONTACTS

[75] Inventor: Robert Scott Turnbull, Glasgow, United Kingdom

[73] Assignee: The Whitaker Corporation, Wilmington, Del.

[21] Appl. No.: 09/068,442

[22] PCT Filed: Nov. 25, 1996

[86] PCT No.: PCT/IB96/01299

§ 371 Date: May 11, 1998

§ 102(e) Date: May 11, 1998

[87] PCT Pub. No.: WO97/22163

PCT Pub. Date: Jun. 19, 1997

[30] Foreign Application Priority Data

Dec. 11, 1995 [GB] United Kingdom ..... 9525266

[51] Int. Cl.[7] ..... H01R 13/62

[52] U.S. Cl. ..... 439/326

[58] Field of Search ..... 439/326, 636, 439/637, 60

[56] References Cited

U.S. PATENT DOCUMENTS 4,575,172 3/1986 Walse et al. ..... 339/75 MP
5,695,353 11/1995 Sakata ..... 439/326

*Primary Examiner*—Steven L. Stephan
*Assistant Examiner*—Javaid Nasri

[57] ABSTRACT

A SIMM connector is provided with two rows of contacts, wherein the contacts are offset in the direction of the row of contacts with respect to each other such that the adjacent contact pads of the SIMM card are contacted alternately on opposite sides of the board. Elimination of redundant contact points enables the contacts to be stamped from the plane of sheet metal into relatively wide beams that enable sufficient contact force but large elastic range, and in particular enable a whole row of contacts to be inserted into the housing in one manufacturing step to reduce manufacturing costs.

8 Claims, 4 Drawing Sheets

PRINTED CIRCUIT BOARD EDGE CARD CONNECTOR HAVING TWO NON-REDUNDANT ROWS OF CONTACTS

BACKGROUND OF THE INVENTION

1. Field of the Invention

This invention relates to a connector for mating with a printed circuit board edge card.

2. Summary of the Prior Art

In applications such as SIMM (Single In-Line Memory Module) and DIMM (Dual In-Line Memory Module) cards for computer systems, memory chips are positioned on a printed circuit and interconnected by circuit traces thereon to a plurality of juxtaposed circuit pads arranged along the edge of the card which can then be plugged into a connector for interconnecting the memory modules to a computer. In many applications, the card must be unpluggable in order to exchange or replace the card. The contact pads arranged along the edge of the card are usually provided on either side of the card. In SIMM cards, aligned contact pads on opposite sides of the board are electrically interconnected. The complementary edge card connector typically has contacts for contacting the contact pads on both sides of the board. An example is shown in U.S. Pat. No. 4,575,172, where each contact has a pair of contact points for contacting opposed aligned contact pads of the PCB. One of the contact points is thus redundant.

The contact pads of most SIMM cards are of tin or similar materials that may oxidize, the complementary contacts of the mating connector also being of a similar material. Due to the presence of oxidation layers that may impair electrical conductivity at the contact surfaces relatively high contact forces are required, and if possible a certain amount of rub during plugging connection in order to break through the oxide layers is desired. High contact forces and large numbers of contacts eliminates the practicability of having a simple plugging connection, which has led to the design of low insertion force systems such as the pivoting board solution as shown in U.S. Pat. No. 4,575,172. The pivoting lever arm effect enables high contact forces for a large number of contacts to be provided. In tin connection surfaces, for example typically used for SIMM card connectors, the requirement for high contact forces in tight spacing means that the contacts are relatively rigid and have a small elastic range. Redundant contacts are important in view of this, because warping or thickness tolerances of a mating PCB may be excessive for a single contact.

In order to generate high forces in tight spacing, SIMM connectors often have contacts edge stamped from sheet metal, where the contact spring beams flex in the plane of the sheet metal. Such contacts are usually individually assembled to connector housings by stitching, which requires a relatively high manufacturing cycle time. There are many other types of low or zero insertion force connection systems, for example some of them hold the opposed contact points apart to enable insertion of the edge card therebetween, subsequently enabling biasing together of the contacts against the contact pads by actuation of a camming mechanism or similar means. Such cammed low insertion or zero insertion force systems are often used with gold plated contact surfaces because much less contact pressure, and no rubbing effect is required between gold contact surfaces. Due to the lower contact force, edge card connector systems with gold plated surfaces are sometimes simply plugged without reducing the insertion forces because the contact forces are sufficiently low to enable this. In a given space, elastic range (flexibility) can also be increased due to the lesser requirement for contact force. Gold plating however, increases the cost of the connection system.

It would be desirable to reduce the cost of such connection systems whilst nevertheless maintaining the requisite level of reliability and performance.

SUMMARY OF THE INVENTION

It is therefore an object of this invention to provide a SIMM connector that is cost-effective, but nevertheless reliable, and enabling low insertion forces.

It is a further object of this invention to provide a cost effective and reliable edge card connector that can support bending of a board for connection thereto whilst nevertheless ensuring reliable contact.

Objects of this invention have been achieved by providing an edge card connector comprising an insulative housing and a plurality of resilient contacts mounted therein and disposed in two rows separated by a gap for receiving an edge card therein, a first row having a plurality of juxtaposed contacts, and a second row having a plurality of juxtaposed contacts that are offset with respect to the first row such that contacts of first and second rows are for connection to contact pads that are offset in the direction of the rows with respect to each other. Advantageously therefore, redundant contacts are eliminated thereby enabling each row to have less (for example half) the number of contacts compared to prior art SIMM connectors. Either a more compact spacing between the edge card contact pads is enabled, or larger contacts can be provided in the connector in order to produce a greater contact force, for example for tin plated contacts.

In an advantageous embodiment, contact points of the opposed contacts can be at different heights, whereby the contact with the lower contact point (i.e. closer to the base of the connector) may be provided with an acute angle V-shaped bend in order to elongate the spring path, thereby increasing the elastic deflection of the contact beam. Adjustment to large tolerances in bending of the board for connection thereto is thus enabled in a reliable manner. The contacts can also be mounted in the housing in a pre-stressed manner by abutment of an extension at the free end of the contacts with a shoulder of the housing such that accurate positioning of the contact surfaces is ensured, and if desired greater contact forces can be achieved.

BRIEF DESCRIPTION OF THE DRAWINGS

Other advantageous features will be apparent from the description, drawings and claims.

An embodiment of this invention will now be described, by way of example, with reference to the figures, whereby.

DETAILED DESCRIPTION OF THE PREFERRED EMBODIMENT

Figure 1:
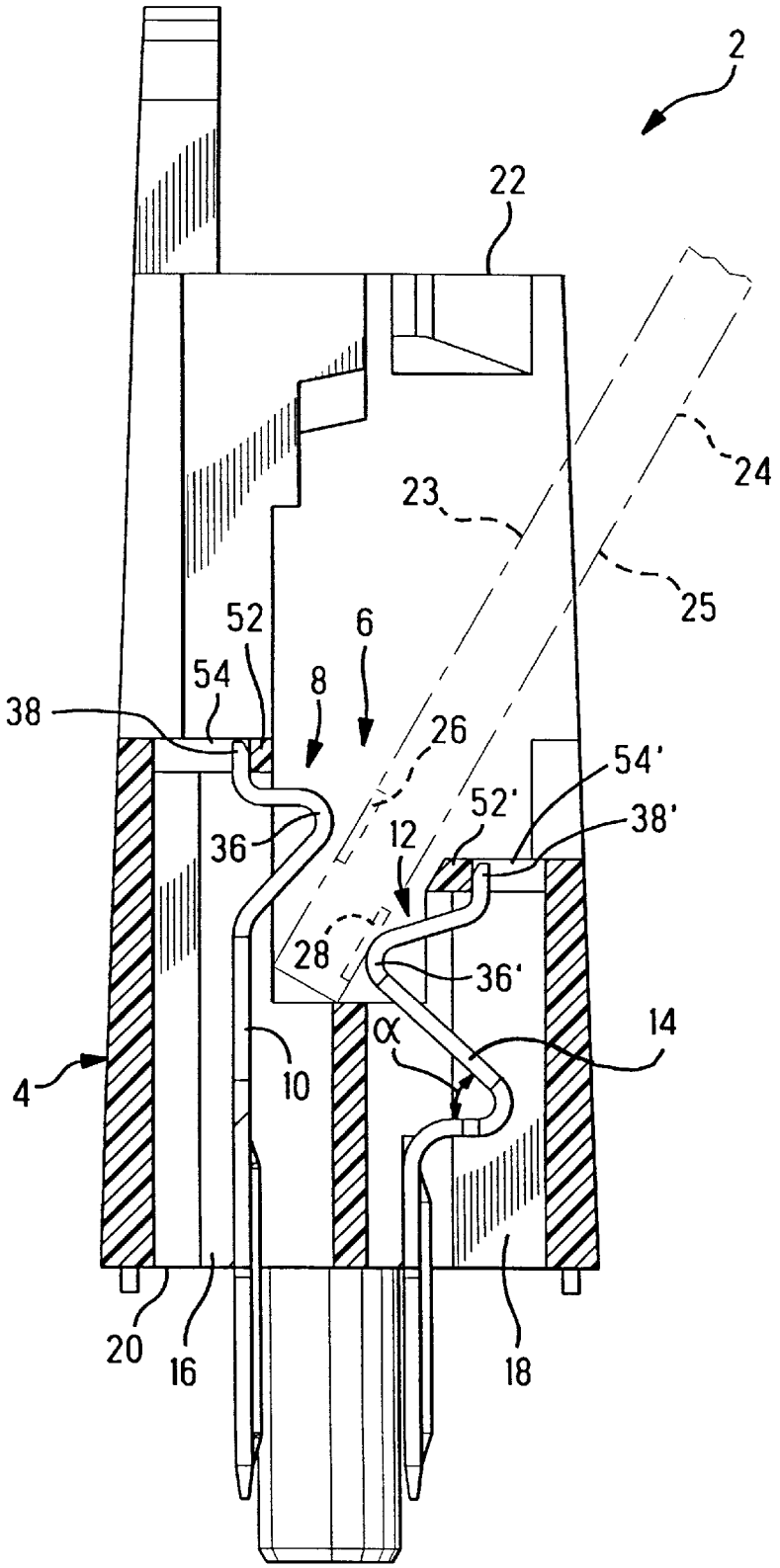
FIG. 1 is a cross sectional view through a SIMM connector according to this invention.
Figure 2:
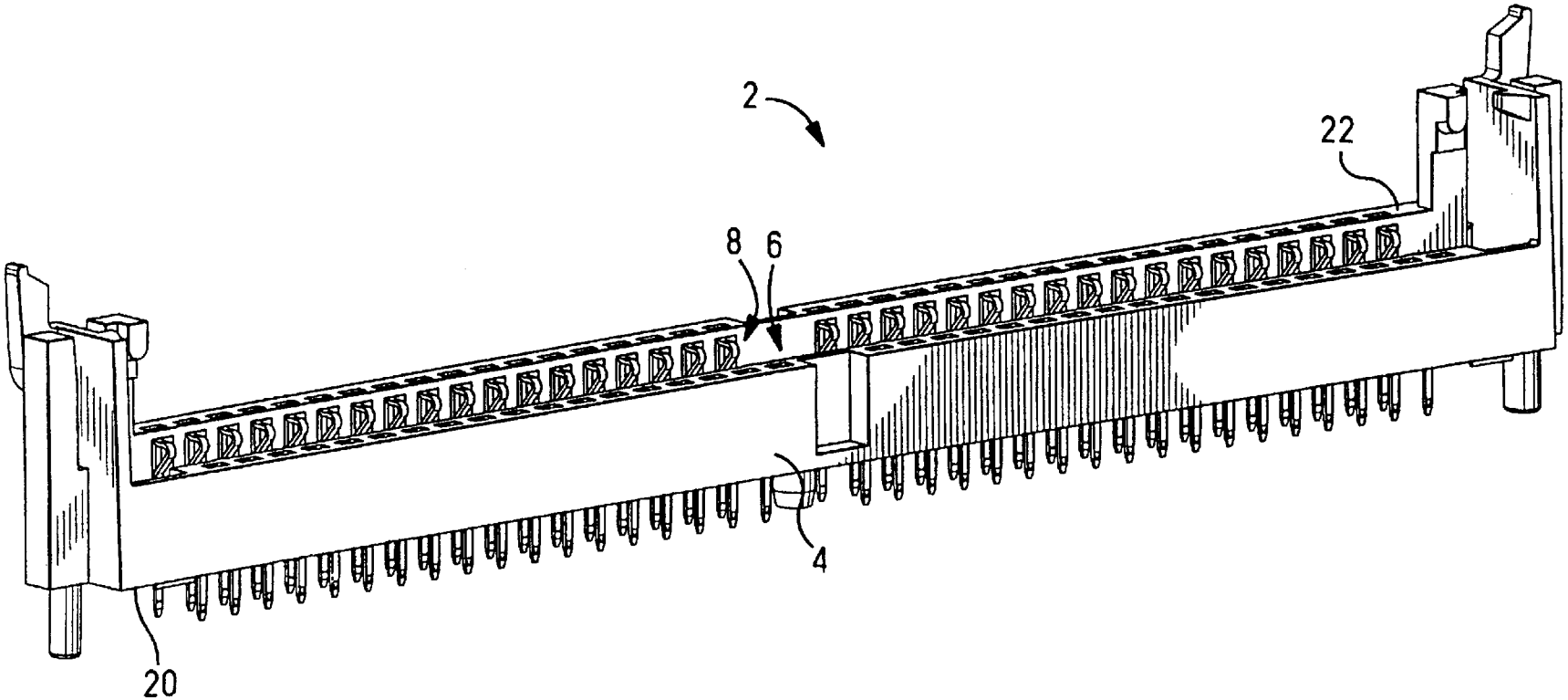
FIG. 2 is an isometric view of the SIMM card of FIG. 1.
Figure 3:
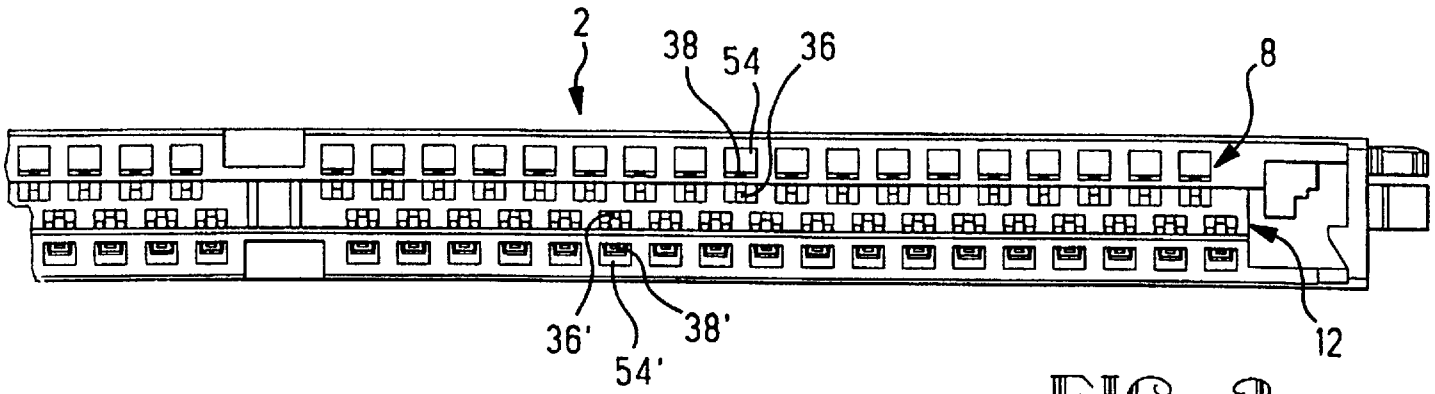
FIG. 3 is a top view of the mating face of part of a SIMM connector according to this invention.

Referring to FIG. 1, a SIMM connector 2 is shown comprising an insulative housing 4, and contacts 6. There 15 is a first row 8 of long contacts 10 and a second row 12 of short contacts 14 parallel thereto.

The insulative housing 4 comprises a plurality of terminal receiving cavities 16 and 18 for receiving the contacts 10 and 14 respectively. The connector housing extends from a mounting face 20 to a card receiving face 22. An edge of a printed circuit board 24 is insertable from the card receiving face 22 between the contact rows 8 and 12 inclined at a certain angle (20–30°) without requiring any insertion force. The card 24 can then be pivoted to the vertical position thereby abutting and resiliently outwardly biasing the opposed contacts 10 and 14 for contact against contact pads 26,28 respectively.

Figure 4:
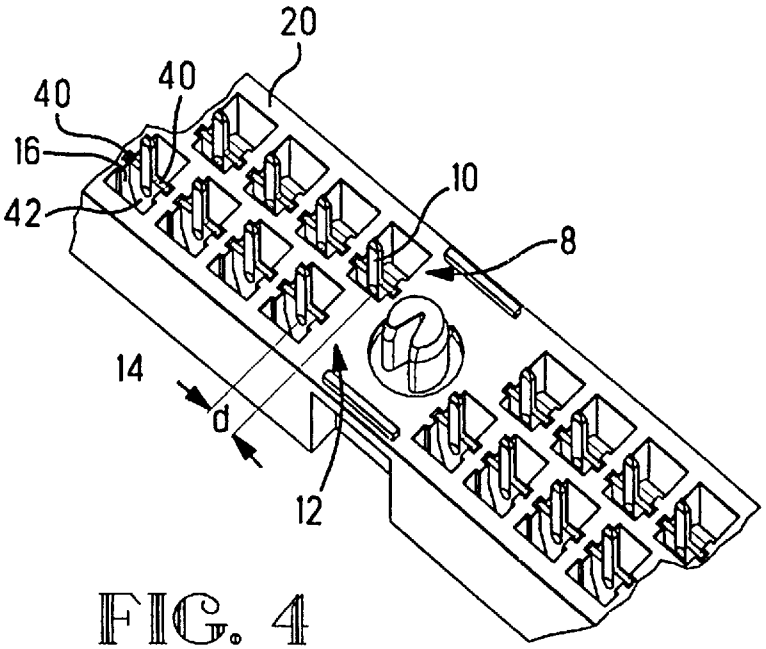
FIG. 4 is an isometric view of the bottom mounting face of part of the SIMM connector.
Figure 7:
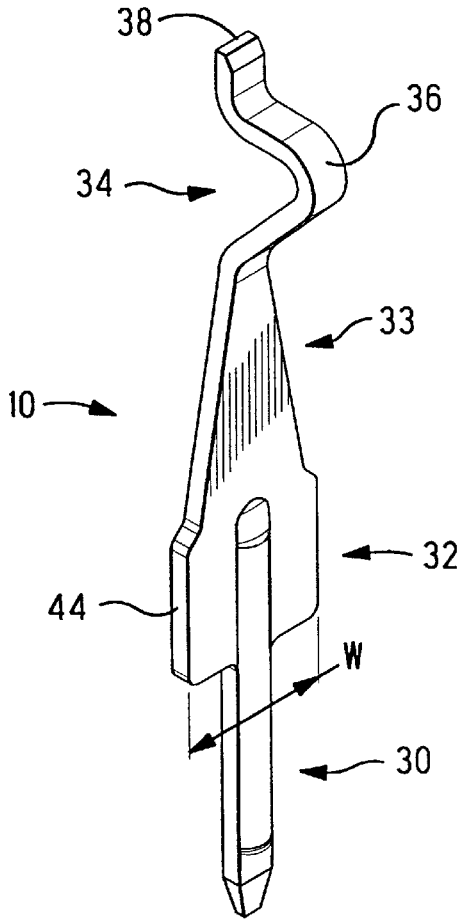
FIG. 7 is an isometric view of a long contact.

Referring to FIG. 7, the long contact 10 is stamped and formed from sheet metal and comprises a connection section 34 contacting a printed circuit board, a base section 32, and a contact section 34 extending from the base section and comprising a contact protrusion 36 proximate a free end 38. The base section 32 is substantially planar and has a width W larger than the free end 38. Between the contact section 34 and the base section 32, is a spring section 33. The spring section has a gradually decreasing width from the base section 32 to the contact section 36. The wide base section 32 enables the contact to be securely seated in slots 40 (see FIG. 4) extending into opposed side walls 42 of the contact receiving cavity 16. Although not shown in FIG. 7, lateral edges 44 of the base section can be provided with retention barbs. The contact can be stitched into the slots 40 from the printed circuit board mounted face 20 of the housing 4.

Figure 6:
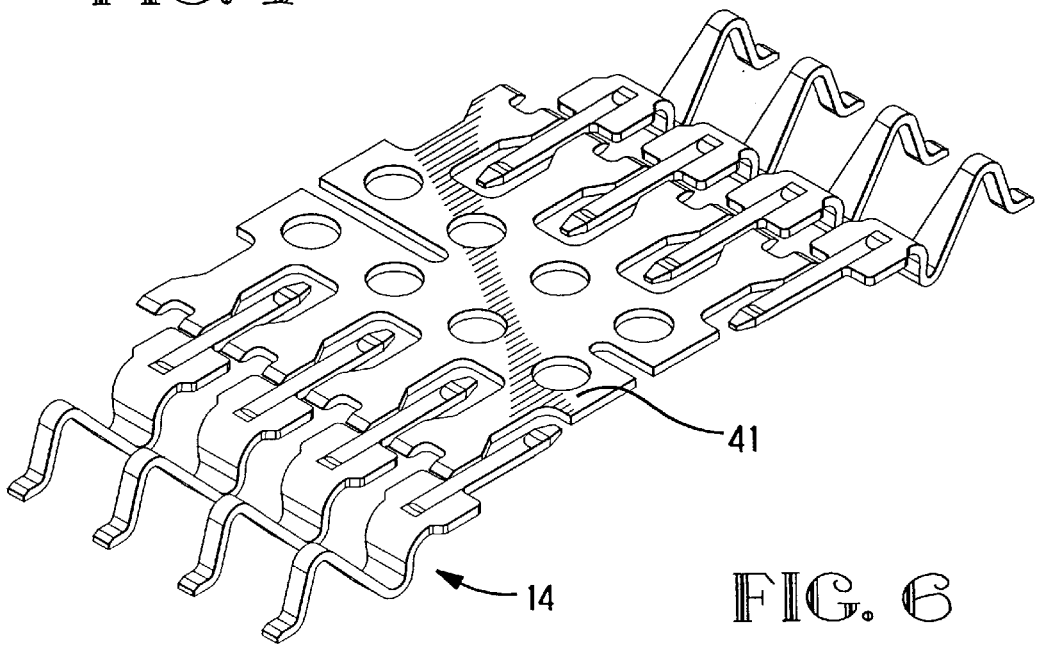
FIG. 6 is an isometric view of the contact stamped and formed from sheet metal still attached to a carrier strip.

During manufacturing, the contacts 10 of the row 8 can be stamped and formed in the same pitch as the positioning within the housing, similar to what is shown in FIG. 6 for the short contacts 14, whereby the whole row 8 of contacts 10 can be inserted into the housing in a single insertion movement by an assembly machine which grips the contacts and cuts away the inter-linking metal parts of the carrier strip 41 prior to insertion in the housing. This reduces assembly costs in comparison to stitching the contacts or mounting the contacts individually into their respective cavities, because it reduces the manufacturing cycle time.

The large width of the base portion 32 enables very stabile and strong support of the contact within the housing, whilst nevertheless enabling provision of optimal resiliency and flexibility via the tapering of the spring arm 33 from the base 32 to the contact protrusion 36. The large width W of the base portion 32 is possible because contacts 14 of the second row 12 are offset by a distance d (see FIG. 4) that is equivalent to the pitch of the contact pads 26,28 of the PCB 24.

In SIMM connectors, contact pads 28 or 26 are interconnected to a contact pad, aligned therewith on the respective opposite side of the circuit board. By contacting alternate contact pads 26 on one side 23 of the PCB 24, by the connector contact 8, and also contacting alternate contact pads 28 offset therefrom by distance D on the other side 25 of the PCB 24, all the connector contacts of the printed circuit board edge are contacted (without redundancy). Rather than producing redundant contacts as in the prior art, therefore, individual contacts 10,14 are provided with higher flexibility in order to compensate for eventual warping of the printed circuit board 24. The use of less contacts also enables the base section to be broader and the spring section to generate sufficiently high forces for oxidizing (tin) contact surfaces. An important advantage is the orientation of the contacts formed form the plane of the sheet metal, and inserted in the cavities in this orientation, to enable simultaneous assembly of the contacts into the housing.

Figure 5:
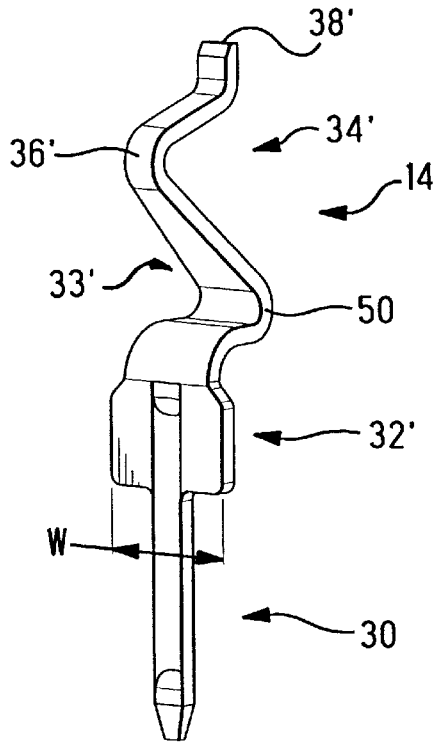
FIG. 5 is an isometric view of a short contact.

Referring to FIG. 5, the short contact 14 comprises a connection section 30, a base section 32' a spring section 33', and a contact section 34' proximate a free end 38'. Due to the lower position of the contact protrusion 36' within the connector as shown in FIG. 1 with respect to the long contact 10, there is less height available for the spring section 33'. In order to provide the contact with a large elastic range, the spring section 33' is provided at an oblique angle and interconnected to the base section 32' via a V-shaped bend 50 having an acute angle a (see FIG. 1). The effective spring length of the spring section 33' is thus enhanced in a compact manner, whilst nevertheless providing the requisite spring force. The spring section 33' also tapers from the wide base section 32' to the narrow contact protrusion 36' in a similar manner to the long contact 10.

As shown in FIG. 6 and already explained hereabove for the long contact 10, the contacts 14 can be stamped and formed from sheet metal at a pitch ready for insertion of the whole row of contacts in one assembly operation into the cavities 18 of the housing.

As shown in FIG. 1, the free ends 38,38' of the contacts abut shoulders 52,52' respectively of the housing to locate the contact protrusions 36,36' precisely. The shoulders 52,52' are provided by provision of cut-outs 54,54' that enable visual inspection from the cord receiving side of correct assembly and positioning of the contacts 10,14 within the housing. Such visual inspection can be provided along the manufacturing process by means of video cameras, for example, forming part of the quality control procedures. If desired, the contracts can also be prestressed in order to increase the contact forces.

We claim:

1. An edge card connector for connection to juxtaposed contact pads disposed on either side and along an edge of a PCB, the connector comprising an insulative housing extending from a mounting face to a card receiving face, a first row of juxtaposed long contacts and a second non-redundant row of juxtaposed short contacts parallel to the first row and spaced therefrom for receiving the PCB therebetween, each long contact having a contact protrusion at a certain height from the mounting face and each short contact having a contact protrusion at a height less than the contact protrusion of the long contact such that the connector is adapted for low insertion force entry of the PCB between the contact rows at an oblique angle, the PCB subsequently pivotable to engage resiliently the contact protrusions against the PCB contact pads, wherein the contacts of the first row are offset a predetermined distance in the direction of the rows, with respect to the contacts of the second row.

2. The connector of claim 1 wherein the offset distance is equal to half the distance between adjacent contacts of one of the rows.

3. The connector of claim 1 wherein the short contact comprises a base section, a spring section, and a contact section comprising the contact protrusion, the spring section being in the shape of a beam extending between the base section and contact section and having a "V" shaped bend.

4. The connector of claim 3 wherein the bend has an acute angle.

5. The connector of claim 1 wherein the contacts have substantially planar base sections for secure mounting and retention in slots of the housing, the base sections and slots substantially disposed in a plane parallel to the contact row direction.

6. The connector of claim 5 wherein the contacts have spring sections that extend from the base sections and taper to the contact protrusion.

7. The connector of claim 1 wherein the contacts have free ends that project into cavities that form shoulders against which the free ends abut, for positioning the contact protrusions, and whereby the free ends are visible from the card receiving end of the connector through the cavities, for visual inspection thereof.

8. The connector of claim 1 wherein each row of contacts is stamped and formed from a plane of sheet metal at a contact pitch corresponding to the contact pitch in the assembled connector, such that a whole row of contacts can be inserted and locked into the connector housing in one assembly insertion step.

* * * * *